US006805593B2

(12) United States Patent
Spaulding et al.

(10) Patent No.: US 6,805,593 B2
(45) Date of Patent: Oct. 19, 2004

(54) QUICK CONNECT BATTERY TERMINAL

(75) Inventors: James R. Spaulding, Macomb, MI (US); Olimpia Maria Hernandez, Birmingham, MI (US); Todd E. Durocher, Warren, MI (US); Craig Rodriguez, Rochester Hills, MI (US); Bernard W. Stone, Detroit, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/322,026

(22) Filed: Dec. 17, 2002

(65) Prior Publication Data

US 2004/0115999 A1 Jun. 17, 2004

(51) Int. Cl.[7] ..... H01R 4/42
(52) U.S. Cl. ..... 439/764
(58) Field of Search ..... 439/764, 762, 439/769, 770, 772, 774, 846, 852, 848, 754

(56) References Cited

U.S. PATENT DOCUMENTS 1,971,706 A * 8/1934 Cook ..... 439/772
3,764,961 A * 10/1973 Poltras ..... 439/759
4,555,159 A * 11/1985 Chartrain et al. ..... 439/773
4,871,957 A 10/1989 Taranto et al. ..... 320/26
4,929,199 A 5/1990 McKinnon ..... 439/759
4,959,031 A * 9/1990 Ruiz et al. ..... 439/759
5,595,510 A * 1/1997 Obligar ..... 439/761
5,597,331 A 1/1997 Gable et al. ..... 439/754
5,620,291 A 4/1997 Hayes et al. ..... 411/552
5,725,399 A 3/1998 Albiez et al. ..... 439/762
5,980,334 A * 11/1999 Pyles ..... 439/764
6,002,235 A 12/1999 Clore ..... 320/105
6,152,784 A * 11/2000 Pyles ..... 439/764
6,232,016 B1 5/2001 Fink ..... 429/178
6,399,239 B2 6/2002 Bolstad et al. ..... 429/100
6,629,863 B2 * 10/2003 Kieninger et al. ..... 439/764

* cited by examiner

*Primary Examiner*—Tulsidas C. Patel
(74) *Attorney, Agent, or Firm*—Laura C. Hargitt

(57) ABSTRACT

A battery assembly for a vehicle includes a battery with a post extending therefrom. A terminal is connected to the post, and a blade extends from the terminal. A battery cable includes an attached connector. The connector is configured to receive the blade in a snap-in relationship. The blade includes a protrusion thereon, and the connector includes a spring member configured to provide sufficient normal force on the blade to force the blade against a wall of the connector to provide a reliable electrical contact. The spring member abuts the protrusion to secure the blade in the connector.

20 Claims, 2 Drawing Sheets

QUICK CONNECT BATTERY TERMINAL

TECHNICAL FIELD

The invention relates to a quick connect battery terminal including a blade extending from the terminal for snap-in cooperation with a connector including a connector spring.

BACKGROUND OF THE INVENTION

Battery posts and terminals typically provide the means by which a battery is electrically connected to electrical components in an automobile. The connections are provided by means of cables electrically connected between the battery posts and the electrical components. The terminal is typically secured to the post by a nut-and-bolt assembly.

Due to packaging constraints, access to the battery posts is often restricted by body and engine components. With the conventional design of battery terminals, tool access to the nut-and-bolt or retainer fastener is required. The fastener is usually secured with an air-powered nut runner, socket and extension. Because the battery is typically installed forward in the engine compartment, it is often installed beneath body structures such as the radiator support rail, or very close to the fender inner panel, which may restrict access to the fastener.

SUMMARY OF THE INVENTION

With the present invention, the terminal includes a blade extending therefrom for engagement with a connector or connector housing which includes a spring for biasing the blade against a wall of the housing to provide a reliable electrical contact. Accordingly, the battery terminal and blade may be previously installed onto the battery for delivery to an assembly plant. Once at the assembly plant, the battery may be installed in the vehicle, and the blade may be attached to a corresponding connector and cable at any time during the assembly process without the need for tools as a result of the snap-in relationship between the blade and connector. In this manner, labor is reduced in the assembly plant and no assembly tools are needed. The invention also alleviates tool access issues related to the installation of the fasteners of conventional battery post terminals.

More specifically, the invention provides a battery assembly for a vehicle including a battery with a post extending therefrom. A terminal is connected to the post, and a blade extends from the terminal. A battery cable includes an attached connector or connector housing. The connector is configured to receive the blade in a snap-in relationship. The blade includes a protrusion thereon and the connector includes a spring member configured to provide sufficient normal force on the blade to force the blade against the wall of the connector to provide a reliable electrical contact. The spring member abuts the protrusion to secure the blade in the connector.

Preferably, the blade is integrally formed with the terminal. Also, the connector is a generally rectangular housing, and the spring member is connected to the housing. The spring member may be generally S-shaped or 7-shaped in vertical cross-section. The blade may be tapered, flat, split into two prongs, or include a V-shaped lower surface.

Preferably, the blade extends in a direction perpendicular to the direction which the post extends from the battery.

The connector housing may include an aperture formed therethrough, and the spring may have a distal end which protrudes through the aperture to facilitate detachment of the blade from the connector housing.

The above objects, features, advantages, and other objects, features and advantages of the present invention are readily apparent from the following detailed description of the best modes for carrying out the invention when taken in connection with the accompanying drawings.

DESCRIPTION OF THE PREFERRED EMBODIMENTS

Figure 1:
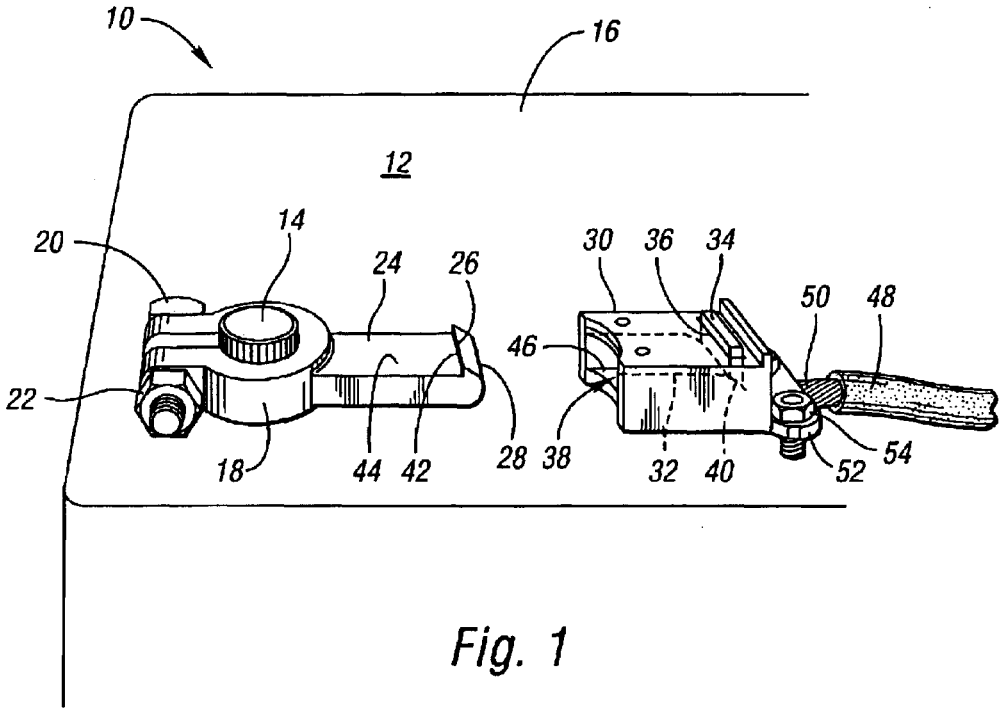
FIG. 1 shows a partial perspective view of a battery assembly in accordance with the invention.

FIG. 1 shows a battery assembly 10 for a vehicle in accordance with the invention. As shown, the battery 12 includes a post 14 extending vertically from a top surface 16 of the battery 12. A terminal 18 is clamped over the post 14 and secured by a bolt 20 and nut 22.

As shown, the terminal 18 includes an integrally formed blade 24 extending from the rear of the terminal. The blade 24 includes a protrusion 26 near the distal end 28 of the blade 24.

A connector or connector housing 30 is a generally rectangular, hollow component formed of aluminum, tin, or lead. The connector 30 includes a steel spring 32 which is generally 7-shaped in vertical cross-section, and includes a distal end 34 protruding through an aperture 36 in the connector 30.

When the blade 24 is inserted into the central opening 38 of the connector 30, the distal end 28 of the blade 24 contacts and displaces the spring 32, until the abutment end 40 of the spring 32 snaps over the protrusion 26, and engages the inner edge 42 of the protrusion 26 to rigidly secure the blade 24 within the connector housing 30.

The steel spring 32 is configured to provide a sufficient normal force downward against the top surface 44 of the blade 24 to force the blade against the lower surface 46 of the connector 30 to provide a reliable electrical connection between the blade 24 and the connector 30.

The cable 48 includes strands of metal wire 50 which are crimped to a plate 52, which is integral with the connector 30, by a nut 54.

Accordingly, in order to electrically connect the cable 48 to the post 14, the connector 30 may be pressed over the blade 24 to snap the spring 32 over the protrusion 26 to rigidly fix the connector 30 to the blade 24 and to provide a reliable electrical connection, without the need for tools to electrically connect the cable.

The distal end 34 of the spring 32 may be grasped and pulled to withdraw the abutment end 40 of the spring 32 from the inner edge 42 of the protrusion 26 to enable detachment of the blade 24 from the connector 30.

Figure 2:
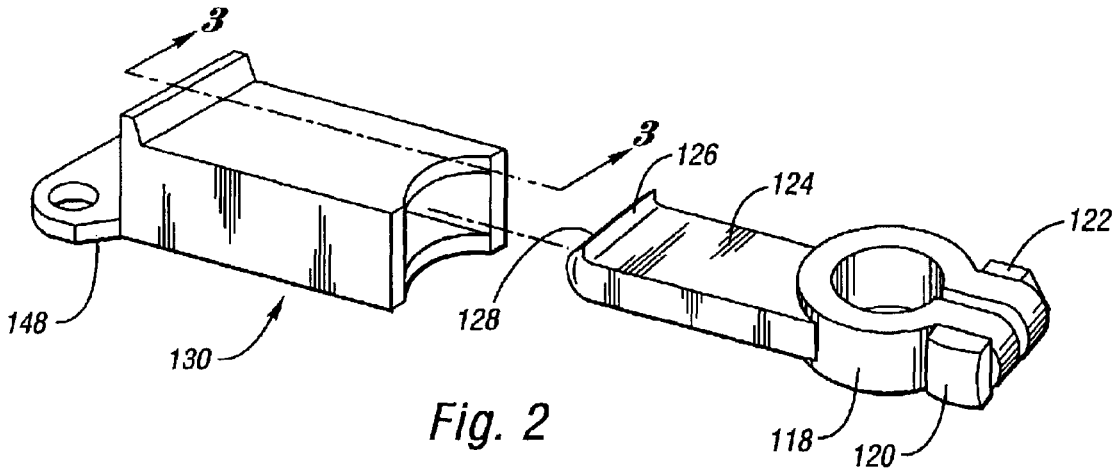
FIG. 2 shows a partially exploded perspective view of a terminal, blade and connector in accordance with a first alternative embodiment of the invention.
Figure 3:
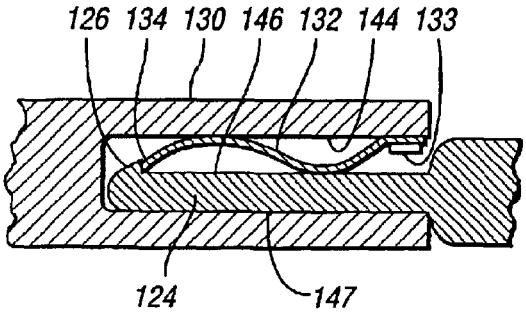
FIG. 3 shows a sectional view taken at line 3—3 of FIG. 2.

Referring to FIGS. 2 and 3, a first alternative embodiment of the invention is shown. As shown, the terminal 118 includes a bolt 120 and nut 122 for connection to the battery post. A blade 124 is integrally formed with and extends from the terminal 118. The blade 124 includes a protrusion 126 extending upward from a distal end 128 of the blade 124. The connector 130 has a steel spring 132 connected to an inside wall thereof by a screw 133. The spring 132 is generally S-shaped in vertical cross-section and has a distal end 134 which abuts the protrusion 126 to secure the blade 124 inside the connector 130.

The cable 148 is connected to the rear of the connector 130.

As shown in FIG. 3, the steel spring 132 is compressed between the inside wall 144 of the connector 132 and the top surface 146 of the blade 124 so that a sufficient normal force is provided against the blade 124 to provide a reliable electrical contact along the surface 147.

When the blade 124 is inserted into the connector 130, the protrusion 126 contacts the spring 132 and flexes the spring to allow the blade 124 to be fully inserted into the connector 130 until the distal end 134 passes over the protrusion 126 and snaps into position against the protrusion 126, thereby securing the blade 124 inside the connector 130.

Figure 4:
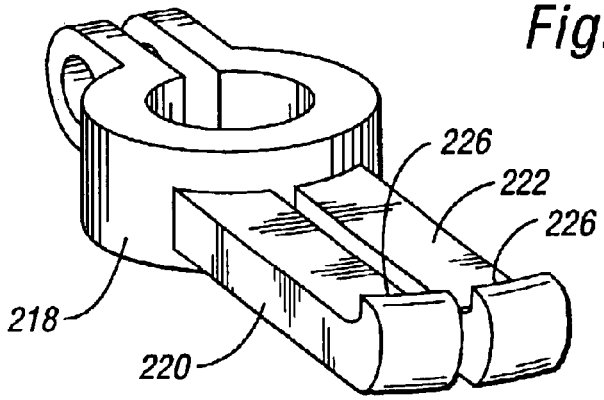
FIG. 4 shows a partial perspective view of a blade and terminal in accordance with a second alternative embodiment of the invention.

FIG. 4 shows a second alternative embodiment of the terminal and blade, wherein the terminal 218 has a blade extending therefrom in the form of first and second prongs 220, 222. The prongs 220, 222 each include a protrusion 226, 228 configured to abut a spring, as described previously.

Figure 5:
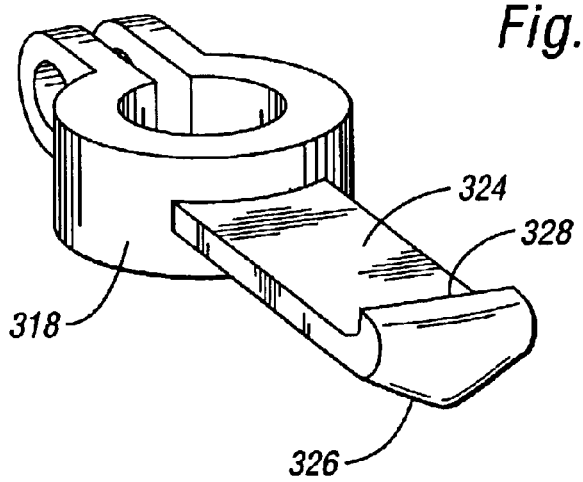
FIG. 5 shows a partial perspective view of a terminal and blade in accordance with a third alternative embodiment of the invention.

FIG. 5 shows a third alternative embodiment wherein a terminal 318 includes a blade 324 protruding therefrom. The blade 324 has a V-shaped bottom surface 326, and includes a protrusion 328 formed thereon to abut a spring as described previously.

Figure 6:
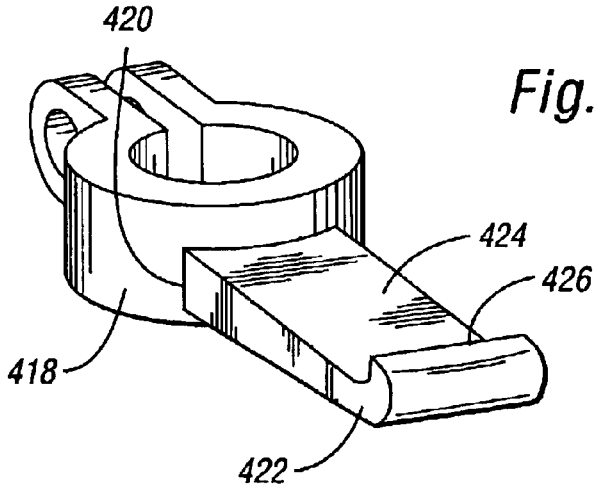
FIG. 6 shows a partial perspective view of a terminal and blade in accordance with a fourth alternative embodiment of the invention.

FIG. 6 shows a fourth alternative embodiment of the invention wherein a terminal 418 includes a blade 424 extending therefrom. The blade 424 is tapered in width, becoming narrower away from the terminal. The width at the base 420 is approximately twice the width of the blade 424 at the distal end 422. The distal end 422 also includes a protrusion 426 extending therefrom for engagement with a spring, as described previously.

While the best modes for carrying out the invention have been described in detail, those familiar with the art to which this invention relates will recognize various alternative designs and embodiments for practicing the invention within scope of the appended claims.

What is claimed is:

1. A battery assembly for a vehicle comprising:

a battery including a post extending therefrom;

a terminal connected to the post;

a blade extending from the terminal; and a battery cable with an attached connector, said connector configured with a housing to receive said blade into said housing in a snap-in relationship.

2. The battery assembly of claim 1, wherein the blade includes a protrusion thereon and the connector includes a spring member configured to provide sufficient normal force on the blade to force the blade against a wall of the connector to provide a reliable electrical contact, and wherein the spring member abuts the protrusion to secure the blade in the connector.

3. The battery assembly of claim 1, wherein said blade is integrally formed with said terminal.

4. A battery assembly for a vehicle comprising:

a battery including a post extending therefrom;

a terminal connected to the post;

a blade extending from the terminal; and a battery cable with an attached connector, said connector configured with a housing to receive said blade into said housing in a snap-in relationship, wherein the blade includes a protrusion thereon and the connector includes a spring member configured to provide sufficient normal force on the blade to force the blade against a wall of the connector to provide a reliable electrical contact, and wherein the spring member abuts the protrusion to secure the blade in the connector, and wherein said housing is generally rectangular and said spring member is connected to the housing.

5. The battery assembly of claim 4, wherein said spring member is generally S-shaped in vertical cross-section.

6. A battery assembly for a vehicle comprising:

a battery including a post extending therefrom:

a terminal connected to the post;

a blade extending from the terminal; and a battery cable with an attached connector, said connector configured with a housing to receive said blade into said housing in a snap-in relationship, wherein the blade includes a protrusion thereon and the connector includes a spring member configured to provide sufficient normal force on the blade to force the blade against a wall of the connector to provide a reliable electrical contact, and wherein the spring member abuts the protrusion to secure the blade in the connector, and wherein said blade is tapered in width, becoming narrower away from the terminal.

7. A battery assembly for a vehicle comprising:

a battery including a post extending therefrom;

a terminal connected to the post;

a blade extending from the terminal; and a battery cable with an attached connector, said connector configured with a housing to receive said blade into said housing in a snap-in relationship, wherein the blade includes a protrusion thereon and the connector includes a spring member configured to provide sufficient normal force on the blade to force the blade against a wall of the connector to provide a reliable electrical contact, and wherein the spring member abuts the protrusion to secure the blade in the connector, and wherein said blade includes first and second prongs.

8. The battery assembly of claim 2, wherein said blade includes a V-shaped lower surface.

9. The battery assembly of claim 1, wherein said blade extends in a direction perpendicular to the post.

10. A battery assembly for a vehicle comprising:

a battery including a post extending therefrom;

a terminal connected to the post;

a blade extending from the terminal; and a battery cable with an attached connector, said connector configured with a housing to receive said blade into said housing in a snap-in relationship, wherein the blade includes a protrusion thereon and the connector includes a spring member configured to provide sufficient normal force on the blade to force the blade against a wall of the connector to provide a reliable electrical contact, and wherein the spring member abuts the protrusion to secure the blade in the connector, and wherein the connector includes an aperture formed therethrough and a distal end of the spring member protrudes through the aperture to facilitate disconnecting the blade from the connector.

11. A cable attachment assembly for a battery including a post extending therefrom, comprising:

a terminal attachable to the post;

a first connector component fixed to the terminal, and a second connector component fixed to a cable; and said first and second connectors configured to provide a snap-in relationship with each other to electrically connect the post and the cable;

wherein said first connector component comprises a blade extending from the terminal and said second connector component comprises a generally rectangular connector housing configured to receive substantially all of the blade into the housing.

12. The cable attachment assembly at claim 11, wherein the blade includes a protusion thereon and the connector housing includes a spring member configured to provide sufficient normal force on the blade to force the blade against a wall of the connector housing to provide a reliable electrical contact, and wherein the spring member abuts the protrusion to secure the blade in the connector housing.

13. The cable attachment assembly of claim 11, wherein said blade is integrally formed with said terminal.

14. The cable attachment assembly of claim 12, wherein said spring member is fixed to the connector housing.

15. The cable attachment assembly of claim 14, wherein said spring member is generally S-shaped in vertical cross-section.

16. The cable attachment assembly of claim 12, wherein said blade is tapered in width, becoming narrower away from the terminal.

17. The cable attachment assembly of claim 12, wherein said blade includes first and second prongs.

18. The cable attachment assembly of claim 12, wherein said blade includes a V-shaped lower surface.

19. The battery assembly of claim 1, wherein said post is positioned on a top surface of the battery.

20. A battery assembly for a vehicle comprising:

a battery including a post extending therefrom;

a terminal connected to the post and including an integrally formed blade extending from the terminal, said blade including a protrusion formed thereon; and a battery cable with an attached connector, said connector configured to receive said blade in a snap-in relationship, wherein the connector is configured as a generally rectangular housing including a spring member connected to the housing and configured to abut the protrusion to secure the blade in the connector, said spring member being generally S-shaped in vertical cross-section.

* * * * *